US009250553B2

(12) United States Patent
Osanishi

(10) Patent No.: US 9,250,553 B2
(45) Date of Patent: Feb. 2, 2016

(54) LIQUID DEVELOPER AND IMAGE FORMING METHOD

(71) Applicant: KYOCERA DOCUMENT SOLUTIONS INC., Osaka (JP)

(72) Inventor: Katsuki Osanishi, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/109,563

(22) Filed: Dec. 17, 2013

(65) Prior Publication Data

US 2014/0170556 A1 Jun. 19, 2014

(30) Foreign Application Priority Data

Dec. 17, 2012 (JP) ..... 2012-275020

(51) Int. Cl.
*G03G 9/00* (2006.01)
*G03G 9/13* (2006.01)
*G03G 9/12* (2006.01)

(52) U.S. Cl.
CPC ..... *G03G 9/131* (2013.01); *G03G 9/122* (2013.01)

(58) Field of Classification Search
CPC ..... G03G 9/00; G03G 9/125; G03G 9/132
USPC ..... 430/115, 112, 114, 117.1, 123.57
See application file for complete search history.

(56) References Cited

U.S. PATENT DOCUMENTS 8,524,435 B2 * 9/2013 Hobo et al. ..... 430/115

FOREIGN PATENT DOCUMENTS

| | | |
|---|---|---|
| JP | 2003-241440 A | 8/2003 |
| JP | 2008-242039 A | 10/2008 |
| JP | 2011-248171 A | 12/2011 |

* cited by examiner

*Primary Examiner* — Thorl Chea
(74) *Attorney, Agent, or Firm* — Studebaker & Brackett PC

(57) ABSTRACT

A liquid developer includes a carrier liquid having insulation property, colored particles, and an organic high molecular compound. The organic high molecular compound is dissolved in the carrier liquid. The organic high molecular compound includes elastomer A that is a styrene-butadiene-based elastomer not having an acid group or a basic group and elastomer B that is a styrene-based elastomer having an acid group or a basic group. A content of the elastomer A in the liquid developer is 6% by mass or more and 8% by mass or less, and a content of the elastomer B in the liquid developer is 0.4% by mass or more and 0.8% by mass or less. The colored particles include aniline black.

4 Claims, 2 Drawing Sheets

LIQUID DEVELOPER AND IMAGE FORMING METHOD

INCORPORATION BY REFERENCE

The present application claims priority under 35 U.S.C. §119 to Japanese Patent Application No. 2012-275020, filed Dec. 17, 2012. The contents of this application are incorporated herein by reference in their entirety.

BACKGROUND

The present disclosure relates to liquid developers and image forming methods using liquid developers.

Generally, development methods for visualizing an electrostatic latent image using charged colored particles are largely divided into dry-type development methods and wet-type development methods. Of these, used in the wet-type development method is a liquid developer obtained by dispersing colored particles in a carrier liquid having electrical insulation property. The charged colored particles in the liquid developer move from the surface of the development roller to the surface of the photosensitive drum according to the principle of electrophoresis, and visualize the electrostatic latent image on the surface of the photosensitive drum. The image thus obtained is transferred from the photosensitive drum onto the recording medium. Since the liquid developer has little possibility of causing scattering of colored particles in the air, it is possible to use fine colored particles having an average particle diameter in submicron size. As a result, it is possible to obtain a high-resolution and high-quality image having excellent tones.

Among image forming methods using the wet-type development methods, a thermal fixing method and an optical fixing method are known as methods for fixing onto a recording medium, an image formed with colored particles. The thermal fixing method is a method for fixing toner onto the recording medium by thermally melting the binder resin, in the case of using the toner in which the colored particles are obtained by dispersing a pigment in the binder resin. The optical fixing method is a method for fixing toner onto the recording medium by using a binder resin having a photoreactive functional group as the binder resin and polymerizing the binder resin by light, in the case of using the toner in which the colored particles are obtained by dispersing a pigment in the binder resin.

However, the thermal fixing method and the optical fixing method require a large amount of thermal energy or light energy for fixing the colored particles onto the recording medium. Thus, in order to reduce the energy consumption in the wet-type development method, there suggested is a liquid developer that includes: a carrier liquid having electrical insulation property, colored particles dispersed in the carrier liquid, and an organic high molecular compound for fixing the colored particles onto the recording medium. This liquid developer characteristically shows that an organic high molecular compound is dissolved in the carrier liquid, and the pigment is used for the colored particles.

SUMMARY

The present disclosure provides the following.

The present disclosure relates to a liquid developer and an image forming method. According to a first aspect of the present disclosure, a liquid developer includes: a carrier liquid having electrical insulation property; colored particles; and an organic high molecular compound. The organic high molecular compound is dissolved in the carrier liquid. The organic high molecular compound includes: elastomer A that is a styrene-butadiene-based elastomer not having an acid group or a basic group; and elastomer B that is a styrene-based elastomer having an acid group or a basic group. The content of the elastomer A in the liquid developer is 6% by mass or more and 8% by mass or less, and the content of the elastomer B in the liquid developer is 0.4% by mass or more and 0.8% by mass or less. The colored particles include aniline black.

A second aspect of the present disclosure relates to a wet-type development method. The wet-type development method includes: charging a surface of a photosensitive drum; forming an electrostatic latent image on the charged surface of the photosensitive drum; developing the electrostatic latent image on the surface of the photosensitive drum, using the liquid developer according to the first aspect; transferring the developed image onto a recording medium; and ejecting the recording medium onto which the image has been transferred, to an ejection section.

DETAILED DESCRIPTION

Figure 1:
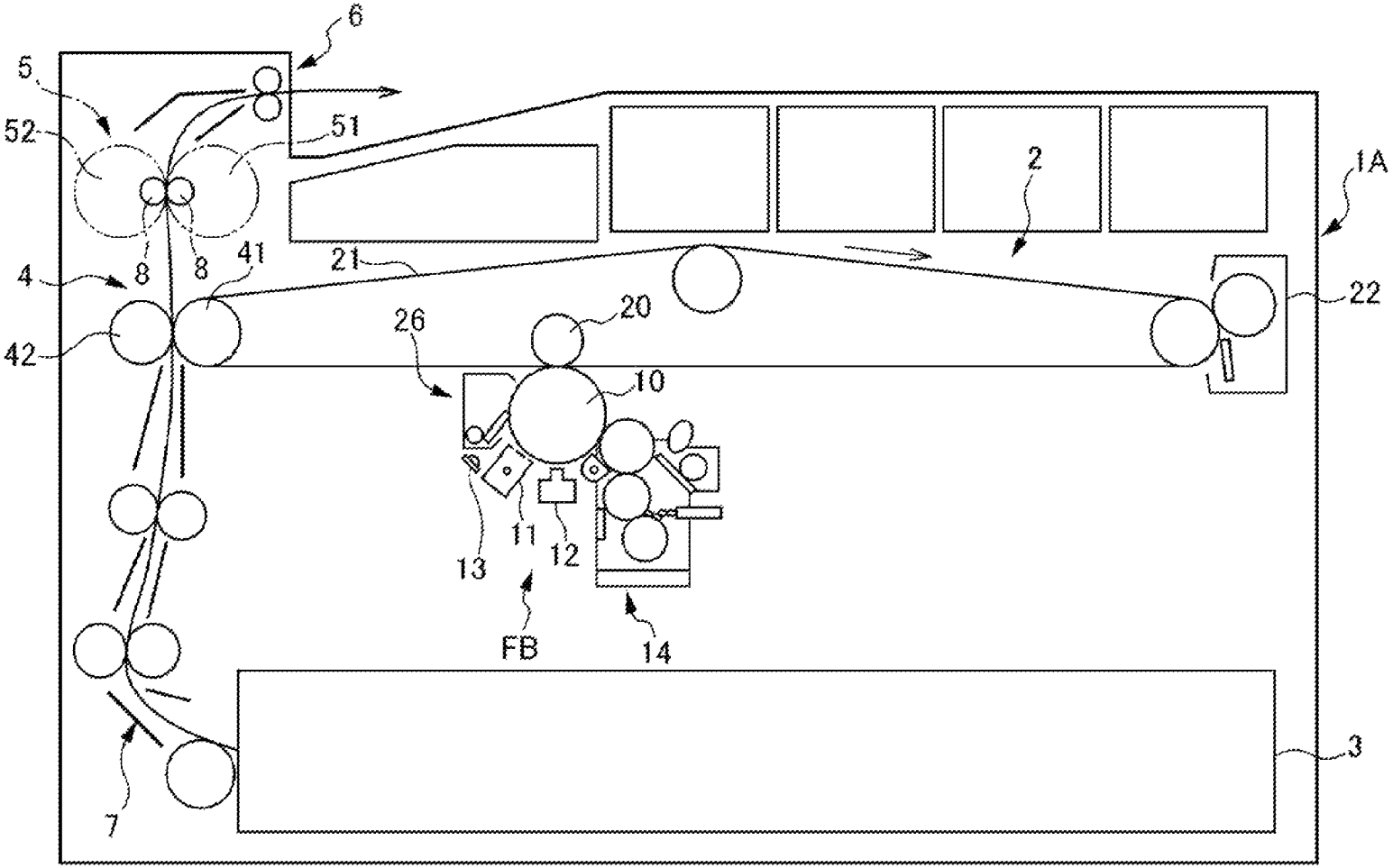
FIG. 1 is a diagram of an image forming apparatus that employs a wet-type development method used for the second embodiment of the present disclosure.

The following describes embodiments of the present disclosure in detail. The present disclosure is not limited by the following embodiments in any case. Within the range of the purpose of the present disclosure, the embodiments can be performed with modifications where appropriate. It should be noted that at points where descriptions are overlapped, such descriptions may be appropriately omitted, which, however, will not limit the content of the present disclosure.

First Embodiment

A first embodiment of the present disclosure relates to a liquid developer. The liquid developer according to the first embodiment includes: a carrier liquid having electrical insulation property, colored particles, and an organic high molecular compound. The organic high molecular compound is dissolved in the carrier liquid and also includes elastomer A that is a styrene-butadiene-based elastomer not having an acid group or a basic group, and elastomer B that is a styrene-based elastomer having an acid group or a basic group. The colored particles include aniline black. The content of the elastomer A in the liquid developer is 6% by mass or more and 8% by mass or less. The content of the elastomer B in the liquid developer is 0.4% by mass or more and 0.8% by mass or less. The carrier liquid may include a component such as a dispersant as desired.

Depending on the combination of the binder resin included in the colored particles and the carrier liquid, there may be cases where a very slight amount of the binder resin is dissolved in the carrier liquid. However, in the present disclosure, such a state is not included in the state where the organic high molecular compound is dissolved in the carrier liquid. That the organic high molecular compound is dissolved in the carrier liquid means that an organic high molecular compound, which is different from the binder resin included in the colored particles, is included in a state of being dissolved in the carrier liquid in an amount that allows achieving the purpose of the present disclosure.

In addition, according to the present disclosure, there may be cases where the liquid developer unavoidably includes an organic high molecular compound that is not dissolved in the carrier liquid due to an environment or conditions such as temperature change or unevenness in the manufacturing condition of the liquid developer. However, within a range that does not interfere with the object of the present disclosure, such an unavoidable inclusion of the organic high molecular compound, which is not dissolved in the carrier liquid in the liquid developer, is permitted. For the unavoidable inclusion of the organic high molecular compound that is not dissolved in the carrier liquid in the liquid developer, specifically, the amount of the organic high molecular compound that is not dissolved in the carrier liquid should preferably be 10% by mass or less with respect to the mass of the entire organic high molecular compound, and more preferably be 5% by mass or less.

Hereinafter, regarding the liquid developer in the first embodiment, the following describes the carrier liquid, the colored particles, the organic high molecular compound, the dispersant, and a method for preparing the liquid developer.

[Carrier Liquid]

For the carrier liquid included in the liquid developer, a liquid having electrical insulation property is generally used. The carrier liquid, which functions as a liquid carrier, is used for the purpose of enhancing the electrical insulation property of the liquid developer to be obtained. The volume resistance of the carrier liquid having electrical insulation property at 25° C. should preferably be $10^{10}$ Ω·cm or more, and more preferably be $10^{12}$ Ω·cm or more.

It is possible to preferably use an organic solvent as the carrier liquid having electrical insulation property. For the organic solvent, for example, it is possible to give: n-paraffin-based hydrocarbon, iso-paraffin-based hydrocarbon, halogenated aliphatic hydrocarbon, and aliphatic hydrocarbon like a mixture of these, which are liquid at normal temperature. The hydrocarbon that is liquid at normal temperature may be straight-chain or branched-chain. For the aliphatic hydrocarbon that is liquid at normal temperature, for example, it is possible to give: n-hexane, n-heptane, n-octane, nonane, decane, dodecane, hexadecane, heptadecane, cyclohexane, perchloroethylene, or trichloroethane.

In addition, in recent years, it has been expected, for various products, to suppress volatilization of the organic compound by reducing the content of the volatile organic compound (VOC). Therefore, for the carrier liquid, a less volatile organic solvent is preferable. The less volatile organic solvent is an organic solvent having a boiling point of 200° C. or more. For such an organic solvent having a high boiling point, for example, it is possible to give a hydrocarbon compound having a high content of aliphatic hydrocarbon with a carbon number of 16 or more (for example, liquid paraffin).

The carrier liquid may be a commercially-available product, and may be an organic solvent that is prepared. The prepared organic solvent is a mixture of more than one organic solvent. For the organic solvent that can be preferably used as the carrier liquid, for example, it is possible to give: "ISOPAR (trademark) G", "ISOPAR (trademark) H", "ISOPAR (trademark) K", "ISOPAR (trademark) L", "ISOPAR (trademark) M", and "ISOPAR (trademark) V" each manufactured by Exxon Mobil Corporation); "MORESCO-WHITE (trademark) P-40" "MORESCO-WHITE (trademark) P-55", "MORESCO-WHITE (trademark) P-70", "MORESCO-WHITE (trademark) P-200", and "MORESCO-WHITE (trademark) P-350", each of which is liquid paraffin manufactured by MORESCO Corporation; "COSMO WHITE P-60", "COSMO WHITE P-70", and "COSMO WHITE P-120", each of which is liquid paraffin manufactured by COSMO OIL Co., Ltd.

[Colored Particles]

The liquid developer according to the present disclosure includes aniline black as colored particles. For the colored particles, aniline black may be used singly, and toner particles containing aniline black in the binder resin may be used. The content of the colored particles in the liquid developer is not particularly limited within a range that does not interfere with the object of the present disclosure. The content of the colored particles in the liquid developer should preferably be 3% by mass or more and 30% by mass or less with respect to the total mass of the liquid developer, and more preferably be 5% by mass or more and 20% by mass or less. In addition, the average particle diameter of the colored particles in the liquid developer should preferably be 0.1 μm or more and 1.5 μm or less, and should preferably be 0.2 μm or more and 1.3 μm or less. The following describes aniline black and toner particles.

(Aniline Black)

As the colorant, the colored particles include aniline black. For adjustment to a desired hue, the colored particles may include a combination of aniline black and publicly-known pigments of various hues. For the pigment used with aniline black, a black pigment is preferable. For the black pigment other than aniline black and addible to the colored particles, for example, it is possible to give carbon black, acetylene black, or lamp black. For the pigments other than aniline black, one type may be used singly, or two or more types may be used in combination. It should be noted that in the case of colored particles formed entirely of aniline black, the content of the aniline black in the liquid developer should preferably be 10% by mass or more and 15% mass or less.

In the case of the colored particles not including the binder resin, the content of aniline black in the colored particles should preferably be 80% by mass or more with respect to the mass of the colored particles, more preferably be 90% by mass or more, and particularly preferably be 100% by mass.

(Toner Particles)

In the case of using toner particles as colored particles, the toner particles include a binder resin, aniline black, and a charge control agent as necessary. The following describes toner particles, in terms of the binder resin, the charge control agent, and the method for manufacturing the toner particles.

(Binder Resin)

The binder resin included in the toner particles is not particularly limited as long as the binder resin is not dissolved in the carrier liquid or only a slightest amount is dissolved to allow maintaining a state where aniline black is dispersed in the binder resin in the liquid developer. The binder resin as described above can be appropriately selected and used from among binder resins used in toner particles included in liquid developers generally used.

For the preferred binder resin, for example, it is possible to give a thermoplastic resin such as: styrene-based resin, acrylic resin, styrene-acrylic copolymer, polyethylene-based resin, polypropylene-based resin, vinyl chloride-based resin, polyester resin, polyamide resin, polyurethane resin, polyvinyl alcohol-based resin, vinyl ether-based resin, or N-vinyl-based resin. Among these resins, polyester resin is preferable in terms of dispersibility of aniline black in the toner particles, chargeability of the toner particles, and fixability onto the recording medium. It should be noted that if the molecular weight is too low, there may be cases where the polyethylene-based resin and the polypropylene-based resin are likely to be dissolved in the carrier liquid depending on the type of the carrier liquid. Therefore, in the case of using the polyethylene-based resin and the polypropylene-based resin as the binder resin, it is necessary to check the solubility of the binder resin to the carrier liquid before preparing the liquid developer.

(Charge Control Agent)

The toner particles may include a charge control agent for the purpose of enhancing the charge level of the toner particles. In the case of positively charging the toner particles for development, a positively chargeable charge control agent is used. In the case of negatively charging the toner particles for development, a negatively chargeable charge control agent is used.

For the positively chargeable charge control agent, for example, it is possible to give: an azine compound such as pyridazine, pyrimidine, pyrazine, ortho-oxazine, meta-oxazine, para-oxazine, ortho-thiazine, meta-thiazine, para-thiazine, 1,2,3-triazine, 1,2,4-triazine, 1,3,5-triazine, 1,2,4-oxadiazine, 1,3,4-oxadiazine, 1,2,6-oxadiazine, 1,3,4-thiadiazine, 1,3,5-thiadiazine, 1,2,3,4-tetrazine, 1,2,4,5-tetrazine, 1,2,3,5-tetrazine, 1,2,4,6-oxatriazine, 1,3,4,5-oxatriazine, phthalazine, quinazoline, or quinoxaline; direct dyes made of an azine compound such as azine fast red FC, azine fast red 12BK, azine violet BO, azine brown 3G, azine light brown GR, azine dark green BH/C, azine deep black EW, or azine deep black 3RL; a nigrosine compound such as nigrosine, nigrosine salt, or a nigrosine derivative; an acid dye made of a nigrosine compound such as nigrosine BK, nigrosine NB, or nigrosine Z; metal salts of naphthenic acid or higher fatty acid; alkoxylated amine; alkylamide; and a quarternary ammonium salt such as benzylmethylhexyldecylammonium or decyltrimethylammonium chloride. Among these positively chargeable charge control agents, the nigrosine compound is particularly preferred for a reason of achieving quicker charge rise characteristic. For these positively chargeable charge control agents, one type may be used singly or two or more types may be used in combination.

Resin with a quaternary ammonium salt, a carboxylate salt, or a carboxyl group as a functional group may also be used as the positively chargeable charge control agent. For the positively chargeable charge control agent, for example, it is possible to give: styrene-based resin with a quaternary ammonium salt, acrylic resin with a quaternary ammonium salt, styrene-acrylic resin with a quaternary ammonium salt, polyester resin with a quaternary ammonium salt, styrene-based resin with a carboxylate salt, acrylic resin with a carboxylate salt, styrene-acrylic resin with a carboxylate salt, polyester resin with a carboxylate salt, styrene-based resin with a carboxyl group, acrylic resin with a carboxyl group, styrene-acrylic resin with a carboxyl group, or polyester resin with a carboxyl group. These resins may be oligomers or polymers.

For the negatively chargeable charge control agent, for example, it is possible to give an organometallic complex or a chelate compound. For the organometallic complex or the chelate compound, it is preferable to use: a metal acetylacetonate complex such as aluminum acetylacetonate or iron (II) acetylacetonate, or a salicylic acid-based metal complex such as 3,5-di-tert-butylsalicylic acid chromium, or salicylic acid-based metal salt. Among the negatively chargeable charge control agents, the salicylic acid-based metal complex or the salicylic acid-based metal salt is more preferable. For these negatively chargeable charge control agents, one type may be used singly or two or more types may be used in combination.

The amount of use of the positively or negatively chargeable charge control agent in the case of using the charge control agent should preferably be 1.5 parts by mass or more and 15 parts by mass or less with respect to 100 parts by mass of the binder resin, more preferably be 2.0 parts by mass or more and 8.0 parts by mass or less, and particularly preferably be 3.0 parts by mass or more and 7.0 parts by mass or less.

(Method for Manufacturing Toner Particles)

The method for manufacturing the toner particles is the same as the method for manufacturing the toner particles generally included in the liquid developer. For the preferred method for manufacturing toner particles, for example, it is possible to mix the binder resin, aniline black, and the charge control agent as desired, using a mixer. The mixture thus obtained is melted and kneaded using a kneader such as an extruder. There is a method of cooling, and then pulverizing and classifying a product obtained from the kneading. The average particle diameter of the toner particles obtained after pulverizing and classifying should preferably be 2 μm or more and 10 μm or less, and more preferably be 4 μm or more and 8 μm or less. In addition, generally, before preparing the liquid developer, the toner particles pulverized and classified are mixed with the carrier liquid and dispersed using a mixing device such as a ball mill, and are used for preparing the liquid developer as a concentrated developer. In this case, the average particle diameter of the colored particles in the concentrated developer should preferably be 0.1 μm or more and 1.5 μm or less, and more preferably be 0.2 μm or more and 1.3 μm or less.

[Organic High Molecular Compound]

The liquid developer includes an organic high molecular polymer in the state of being dissolved in the carrier liquid. In the case of the liquid developer including the organic high molecular compound in the state of being dissolved in the carrier liquid, the concentration of the organic high molecular compound in the state of being dissolved in the carrier liquid that is present on the surface of the recording medium becomes higher as the penetration into the recording medium or drying of the carrier liquid progresses. Then, as a result of the concentration of the organic high molecular compound in the carrier liquid exceeding the saturated solubility, a coating film of the organic high molecular compound is formed on the colored particles deposited onto the surface of the recording medium. This results in progress in fixing the colored particles onto the recording medium.

In the liquid developer according to the present disclosure, the organic high molecular compound includes elastomer A that is a styrene-butadiene-based elastomer not having an acid group or a basic group, and elastomer B that is a styrene-based elastomer having an acid group or a basic group. The following describes the elastomer A and the elastomer B.

(Elastomer A)

The elastomer A is a styrene-butadiene-based elastomer not having an acid group or a basic group. Here, the acid group or the basic group is a functional group classified as acid or base according to the definition of Brønsted-Lowry. The styrene-butadiene-based elastomer (SBS) has excellent solubility to the carrier liquid. Thus, by the liquid developer including the styrene-butadiene-based elastomer (SBS), it is possible to obtain a sufficiently fixed image even in the case of fixing the image without providing energy using such a method as heating for fixing. For the elastomer A, the styrene-butadiene-based elastomer (SBS) including a polymer block A and a polymer block B as represented by Formula (1) below is preferable.

[Formula 1]

(1)

Polymer block A Polymer block B

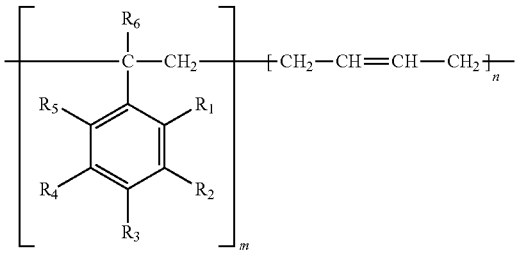

[in Formula (1), each of $R_1$, $R_2$, $R_4$, $R_5$, and $R_6$ is a hydrogen atom or a methyl group independently, and $R_3$ is a hydrogen atom, a saturated alkyl group having a carbon number of 1 or more to 20 or less, a methoxy group, an ethoxy group, a phenyl group, or a halogen atom. m and n are integers such that the amount of the polymer block A included in the styrene-butadiene-based elastomer is 5% by mass or more and 75% by mass or less.

The styrene-butadiene-based elastomer can be obtained by copolymerizing a styrene-based monomer and butadiene that is a conjugated diene compound. Since the elastomer A does not have an acid group or a basic group, the styrene-butadiene-based elastomer can be obtained by copolymerizing the styrene-based monomer and butadiene, each of which does not have an acid group or a basic group.

As the styrene-based monomer included in the elastomer A, for example, it is possible to give a monomer such as styrene, α-methylstyrene, o-methylstyrene, m-methylstyrene, p-methyl styrene, p-ethylstyrene, 2,4-dimethylstyrene, p-n-butylstyrene, p-dodecylstyrene, p-methoxystyrene, or p-phenylstyrene.

The amount of a unit derived from the styrene-based monomer included in the elastomer A (the content of the polymer block A) should preferably be 5% by mass or more and 75% by mass or less, and more preferably be 10% by mass or more and 65% by mass or less. With the liquid developer including the elastomer A in which the content of the styrene-based monomer is too low, since the glass transition point of the coating film of the elastomer A is too low, there may be cases where it is difficult to form the coating film including the elastomer A on the surface of the colored particles when fixing the colored particles onto the recording medium. On the other hand, in the liquid developer including the elastomer A in which the content of the styrene-based monomer is too high, there may be cases where it is difficult to sufficiently fix the colored particles onto the recording medium because the softening point of the coating film, which includes the elastomer A and covers the colored particles on the recording medium, is too high.

For the elastomer A, it is possible to use any one of commercially-available products and synthetic products. For commercially-available products of the elastomer A, it is possible to give those such as: "Septon" and "Hybrar" manufactured by Kuraray, "Kraton" by SHELL, "Asaplen (trademark)" and "Tafplen (trademark)" each manufactured by Asahi Kasei Chemicals Corporation, and "Dynaron" manufactured by JSR Corporation. For these elastomers A, one type may be used singly, or two or more types may be used in combination.

In the liquid developer according to the present disclosure, the content of the elastomer A with respect to the mass of the liquid developer should preferably be 6% by mass or more and 8% by mass or less. In the case of using the liquid developer in which the content of the elastomer A is too low, there may be cases where it is difficult to coat the colored particles on the recording medium with the coating film consisting of the organic high molecular compound, thus making it difficult to sufficiently fix the colored particles onto the recording medium. On the other hand, in the case of using the liquid developer in which the content of the elastomer A is too high, the coating film becomes dry less quickly with an increase in the amount of the coating film of the organic high molecular compound remaining on the surface of the recording medium. Thus, if the drying of the coating film of the organic high molecular compound remaining on the surface of the recording medium is not sufficient, the viscosity (stickiness) of the coating film becomes excessively large, which may cause a significant decrease in the rubfastness of the image.

(Elastomer B)

The elastomer B is a styrene-based elastomer having an acid group or a basic group. The elastomer B is a styrene-based elastomer, and therefore has excellent compatibility with the elastomer A. The elastomer B has an acid group or a basic group, and is therefore easily adsorbed onto the surface of the aniline black included in the colored particles. Thus, with the liquid developer according to the present disclosure including a predetermined amount of the elastomer B, it is possible to sufficiently fix the aniline black in the liquid developer onto the recording medium.

For the elastomer B, for example, it is possible to give a block copolymer consisting of a unit derived from an aromatic vinyl compound and a unit derived from an olefin-based compound or conjugated diene compound, and in which one or both of the unit derived from the aromatic vinyl compound and the unit derived from the olefin-based compound or the conjugated diene compound have an acid group or a basic group. For the block copolymer as above, for example, it is possible to give a block copolymer including a polymer block A derived from the aromatic vinyl compound, and a polymer block B derived from the olefin-based compound or the conjugated diene compound as shown in Table (1) below.

[A–B]x–A (2)

[In Formula (2), x is an integer. The number average molecular weight of the block copolymer represented in Formula (2) is 1,000 or more and 100,000 or less.]

For the aromatic vinyl compound included in the polymer block A that is included in the block copolymer as represented by Formula (2), for example, it is possible to give a compound such as: styrene, α-methylstyrene, o-methylstyrene, m-methylstyrene, p-methylstyrene, 2-3-dimethylstyrene, 2,4-dimethylstyrene, monochlorostyrene, dichlorostyrene, p-bromostyrene, 2,4,5-tribromostyrene, 2,4,6-tribromostyrene, o-tert-butylstyrene, m-tert-butylstyrene, p-tert-butylstyrene, ethylstyrene, vinylnaphthalene, or vinylanthracene. The polymer block A may be derived from one type of aromatic vinyl compound or may be derived from two or more types of aromatic vinyl compound. The elastomer B should preferably include the polymer block A derived from styrene and/or α-methylstyrene.

For the olefin-based compound included in the polymer block B that is included in the block copolymer as represented in Formula (2), for example, it is possible to give a compound such as: ethylene, propylene, 1-butene, 2-butene, isobutene, 1-pentene, 2-pentene, cyclopentene, 1-hexene, 2-hexene, cyclohexene, 1-heptene, 2-heptene, cycloheptene, 1-octene, 2-octene, cyclooctene, vinylcyclooctene, vinylcyclohexene, vinylcycloheptene, or vinylcyclooctene. In addition, for the conjugated diene compound, for example, it is possible to give a compound such as: butadiene, isoprene, chloroprene, 2,3-dimethyl-1,3-butadiene, 1,3-pentadiene, or 1,3-hexadiene. The polymer block B may be derived from one type of compound selected from olefin-based compounds or conjugated diene compounds, or may be derived from two or more types of compounds. The elastomer B should preferably include the polymer block B derived from butadiene, and/or isoprene.

As the acid group included in the styrene-based elastomer, for example, it is possible to give a hydroxyl group, a carboxyl group, and a sulfo group. In addition, for the basic group included in the styrene-based elastomer, for example, it is possible to give an amino group. For the aromatic vinyl compound in which the acid group can be introduced into the polymer block A, for example, it is possible to give a compound such as styrenesulfonic acid, carboxystyrene, or hydroxystyrene. For the aromatic vinyl compound in which the basic group can be introduced into the polymer block A, for example, it is possible to give a compound such as aminostyrene, N-methylamino styrene, N,N-dimethylaminostyrene, N-ethylstyrene, or N,N-diethylaminostyrene. For the olefin-based compound in which the acid group can be introduced into the polymer block B, for example, it is possible to give a compound such as: (meth)acrylic acid, crotonic acid, 2-(meth)acryloyloxyethylsuccinic acid, 2-(meth)acryloyloxyethyladipic acid, 2-(meth)acryloyloxyethylphthalic acid, 2-(meth)acryloyloxyethylhexahydrophthalate acid, 2-(meth) acryloyloxyethylmaleic acid, 2-(meth)acryloyloxypropylsuccinic acid, 2-(meth)acryloyloxypropyladipic acid, 2-(meth)acryloyloxypropyltetrahydrophthalic acid, 2-(meth) acryloyloxypropylphtalic acid, 2-(meth)acryloyloxypropylmaleic acid, 2-(meth)acryloyloxybutylsuccinic acid, 2-(meth)acryloyloxybutyladipic acid, 2-(meth)acryloyloxybutylhydrophthalic acid, 2-(meth)acryloyloxybutylphthalic acid, or 2-(meth)acryloyloxybutylmaleic acid(meth). For the olefin-based compound in which the basic group can be introduced into the polymer block B, for example, it is possible to give a compound such as: aminoethyl (meth)acrylate, dimethylaminoethyl (meth)acrylate, diethylaminoethyl (meth) acrylate, dipropylaminoethyl (meth)acrylate, or dibutylaminoethyl (meth)acrylate.

For the styrene-based elastomer having an acid group or a basic group, that is, the elastomer B, any one of commercially-available products and synthetic products can be used. For commercially-available products of the elastomer B, for example, it is possible to give: "TAFTEC (trademark) MP10", "TAFTEC (trademark) M1943", "TAFTEC (trademark) M1941", "TAFTEC (trademark) M1913", or "TAFTEC (trademark) M1911" each manufactured by Asahi Kasei Chemicals Corporation. For these styrene-based elastomers, one type may be used singly, or two or more types may be used in combination.

In the liquid developer according to the present disclosure, the content of the elastomer B with respect to the mass of the liquid developer should preferably be 0.4% by mass or more and 0.8% by mass or less. In the case of using the liquid developer in which the content of the elastomer B is too low, since it is difficult to sufficiently disperse aniline black in the liquid developer, there may be cases where it is difficult to sufficiently fix the colored particles onto the recording medium. On the other hand, if the content of the elastomer B is too high, the viscosity of the liquid developer becomes high and therefore the elastomer B may block the electrophoresis of the colored particles.

The total amount of the content of the elastomer A and the content of the elastomer B in the organic high molecular compound should preferably be 90% by mass or more, more preferably be 95% by mass or more, and particularly preferably be 100% by mass.

In the case of the organic high molecular compound including a high molecular compound other than the elastomer A and the elastomer B, the type of the high molecular compound is not particularly limited as long as the high molecular compound does not interfere with the object of the present disclosure and is soluble in the carrier liquid. For the high molecular compound other than the elastomer A and the elastomer B, one type may be used singly, or two or more types may be used in combination.

The mass average molecular weight of the organic high molecular compound should preferably be 40,000 or more and 150,000 or less, and more preferably be 60,000 or more and 120,000 or less. By using the organic high molecular compound having a mass average molecular weight within such a range, it is possible to sufficiently fix the colored particles onto the recording medium. The mass average molecular weight of the organic high molecular compound can be measured using, for example, a gel permeation chromatography (GPC).

[Dispersant]

The liquid developer according to the first embodiment may contain a dispersant. In the case of the liquid developer containing the dispersant, the colored particles are sufficiently dispersed in the liquid developer. Thus, it is possible to adjust the particle diameter of the colored particles in the liquid developer to a desired particle diameter.

The dispersant is not particularly limited as long as the dispersant can sufficiently disperse the colored particles in the liquid developer. The dispersant can be appropriately selected from among various types of dispersants generally used as dispersants for colored particles or pigments. For the dispersants, any one of commercially-available products and synthetic products can be used.

For the dispersant, for example, it is possible to give: carboxylate ester containing a hydroxyl group, long chain polyaminoamide, or high molecular weight acid ester salt, high molecular weight polycarboxylic acid salt, high molecular weight unsaturated acid ester, high molecular copolymer, modified polyacrylate, aliphatic polycarboxylic acid, naphthalenesulfonic acid-formaldehyde condensate, polyoxyethylene alkyl phosphate ester, a pigment derivative, and a high molecular For commercially-available products of the preferred dispersant, for example, it is possible to give: "BYK-116" manufactured by BYK Japan KK, "Solsperse 9000", "Solsperse 11200", "Solsperse 13940", "Solsperse 16000", "Solsperse 17000", or "Solsperse 18000" each manufactured by Lubrizol Japan Limited, or "Antaron (trademark) V-216" or "Antaron (trademark) V-220" each manufactured by ISP Japan Ltd.

The content of the dispersant in the liquid developer should preferably be 1% by mass or more and 10% by mass or less, and more preferably be 2% by mass or more and 6% by mass or less.

[Method for Preparing the Liquid Developer]

The method for preparing the liquid developer is not particularly limited within a range that does not interfere with the object of the present disclosure. For a preferred method for preparing the liquid developer, for example, it is possible to give a preparation method as below. The carrier liquid and the organic high molecular compound are mixed and thermally treated, so as to prepare an organic high molecular solution. Next, the organic high molecular solution thus obtained and the colored particles are mixed, so as to prepare a mill base. The mill base thus obtained is wet pulverized such that the colored particles have a desired average particle diameter, so as to prepare a liquid developer.

For the preferred method for preparing the organic high molecular solution, for example, it is possible to give a method of thermally treating the carrier liquid and the organic high molecular compound while sufficiently stirring and mixing the carrier liquid and the organic high molecular compound, or a method of mixing the carrier liquid and the organic high molecular compound using a mixing device such as a ball mill and putting the obtained mixture in a container such as a beaker and thermally treating the mixture.

For a preferred method for preparing the mill base, for example, it is possible to give a method of dispersing and mixing, while dispersing the colored particles, the organic high molecular solution and the colored particles by using a mixer such as a Homo Mixer or a homogenizer capable of mixing the organic high molecular solution and the colored particles. It should be noted that when preparing the mill base, it is possible, as desired, to further add the dispersant to the colored particles and the organic high molecular solution.

For the apparatus used for wet pulverizing the mill base, for example, it is possible to give a rocking mill ("RM-10" manufactured by SEIWA GIKEN Co., Ltd.").

With the liquid developer according to the first embodiment as described above, it is possible to sufficiently fix the colored particles onto the recording medium while reducing the amount of consumption of the thermal energy or light energy for fixing the colored particles onto the recording medium. Thus, the liquid developer according to the first embodiment is preferably used in a various types of image forming apparatuses adopted the wet-type development method.

Second Embodiment

A second embodiment of the present disclosure relates to an electrographic image forming method using the wet-type development method in which the liquid developer according to the first embodiment is used. The image forming method according to the second embodiment includes: a charging process, an exposure process, a development process, a transfer process, and an ejection process. The charging process is a process for charging the surface of a photosensitive drum. The exposure process is a process for forming an electrostatic latent image on the charged surface of the photosensitive drum. The development process is a process for developing the electrostatic latent image on the surface of the photosensitive drum, using the liquid developer. The transfer process is a process for transferring the developed image onto the recording medium. The ejection process is a process for ejecting the recording medium on which the image has been transferred, into an ejection section. The following describes the image forming method using a monochrome printer as an image forming apparatus for which the wet-type development method is employed.

Figure 2:
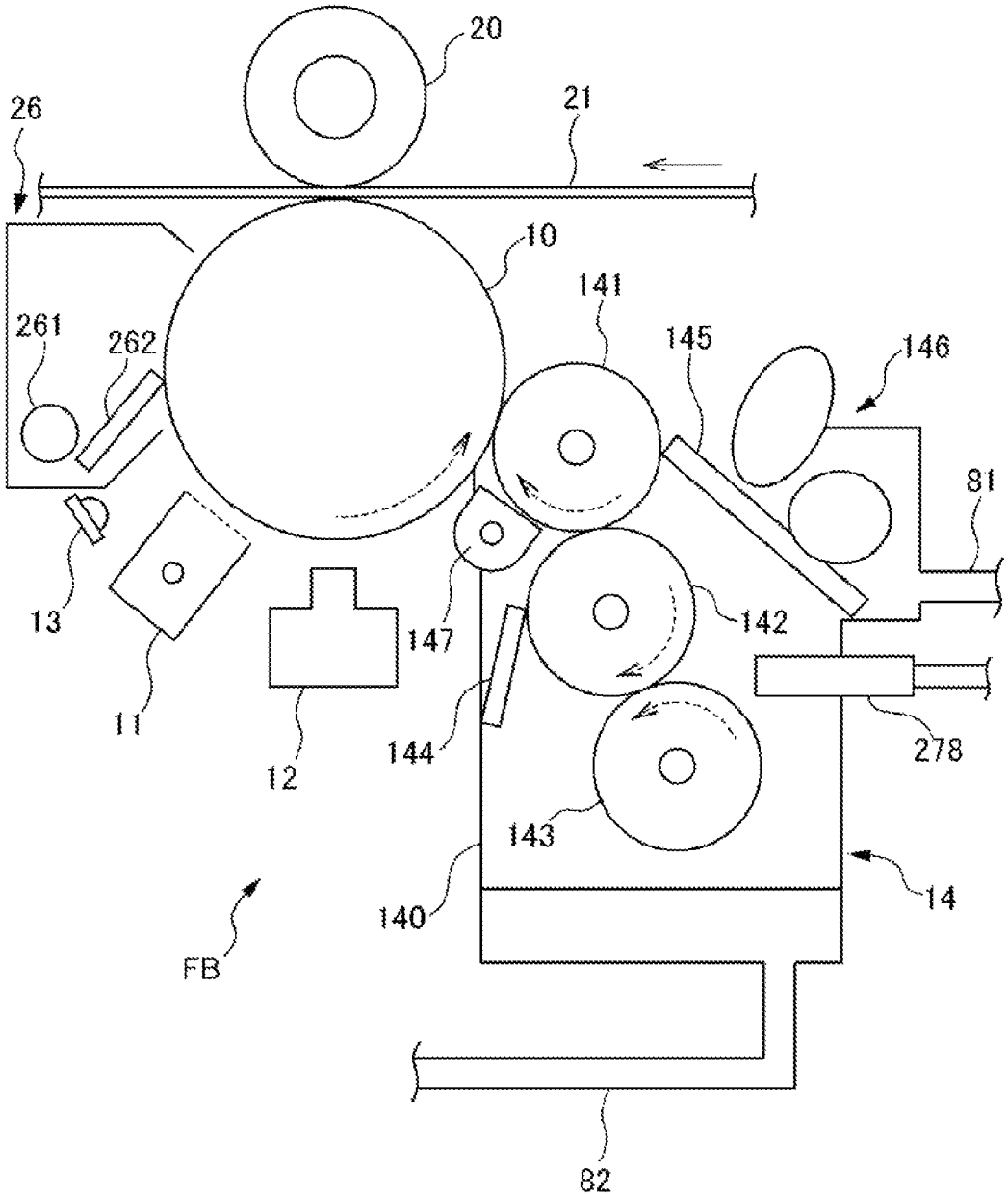
FIG. 2 is a diagram showing a liquid development device included in the image forming apparatus that employs a wet-type development method as shown in FIG. 1 and a peripheral portion thereof.

FIG. 1 is a diagram of a wet-type image forming apparatus used for forming an image with the liquid developer according to the present disclosure. FIG. 2 is a diagram showing the liquid development device included in the wet-type image forming apparatus as shown in FIG. 1 and the periphery thereof. It should be noted that the image forming method is described by taking a monochrome printer for example. The image forming method using the liquid developer according to the first embodiment of the present disclosure is applicable to an image forming apparatus such as a copier, a facsimile device, or a multifunction peripheral that has a combination of these functions, or any other wet-type image forming apparatus capable of forming images on the recording medium.

A wet-type image forming apparatus 1A in FIG. 1 is used in the image forming method using the liquid developer according to the present disclosure. As shown in FIG. 1, the wet-type image forming apparatus 1A houses various units or parts for image forming. The wet-type image forming apparatus 1A further houses a liquid developer circulating device for black (Bk) below the part shown in FIG. 1, but the illustration thereof is omitted here.

The wet-type image forming apparatus 1A includes: an image forming section 2, a recording medium storage section 3, a secondary transfer section 4, an ejection section 6, and a recording medium conveyance section 7. The image forming section 2 forms an image based on the image data. The recording medium storage section 3 stores a recording medium. The secondary transfer section 4 transfers the image formed in the image forming section 2, onto the recording medium. The ejection section 6 ejects the recording medium onto which the transfer of the image is completed, to the outside of the apparatus. The recording medium conveyance section 7 feeds the recording medium from the recording medium storage section 3 to the ejection section 6.

Generally, in a wet-type image forming apparatus 1A, a fixing section 5 including a heating roller 51 and a pressure roller 52 is provided between the secondary transfer section 4 and the ejection section 6, as indicated by a virtual line in the figure. The heating roller 51 and the pressure roller 52 are oppositely located to sandwich the recording medium so as to fix the transferred image onto the recording medium.

However, the wet-type image forming apparatus 1A that is used for the image forming method using the liquid developer according to the present disclosure does not include the fixing section 5 as above. The wet-type image forming apparatus 1A includes, instead of the fixing section 5, only a pair of rollers 8 simply for feeding the recording medium. In other words, in the wet-type image forming apparatus 1A according to the present embodiment, by use of the liquid developer according to the first embodiment, it is possible to fix, onto the recording medium, the image transferred onto the recording medium, without providing thermal energy or light energy to the recording medium through the fixing section 5. More specifically, according to the image forming method in the second embodiment, it is possible to cut the fixing section 5 using the heat energy or light energy that is generally used. Thus, according to the image forming method in the second embodiment, it is possible to simplify the configuration of the wet-type image forming apparatus 1A, thus allowing reduction in the material costs and assembly costs of the wet-type image forming apparatus 1A.

The image forming section 2 includes an intermediate transfer belt 21, a cleaning section 22 for the intermediate transfer belt 21, and an image forming unit FB for black (Bk).

The intermediate transfer belt 21 is a wide and endless belt member having electrical conduction property. In FIG. 1, the intermediate transfer belt 21 is circularly driven in a clockwise direction. In the circular driving of the intermediate transfer belt 21, a face facing outward is referred to as a "surface" and a face facing inward is referred to as a "rear surface".

The image forming unit FB includes a photosensitive drum 10, a charging device 11, an LED exposure device 12, a liquid development device 14, a primary transfer roller 20, a cleaning device 26, and a charge neutralizing device 13.

A surface (circumferential surface) of the photosensitive drum 10 having a columnar shape can bear an image visualized with colored particles that are electrically charged. The photosensitive drum 10 shown in the figure is rotatable in an anticlockwise direction.

The charging device 11 uniformly charges the surface of the photosensitive drum 10. The operation of this charging device 11 constitutes the charging process.

The LED exposure device 12 includes a LED as a light source. The LED exposure device 12 irradiates, with light, the uniformly-charged surface of the photosensitive drum 10, based on the image data input from an outside device. Thus, an electrostatic latent image based on the image data is formed on the surface of the photosensitive drum 10. The operation of this exposure device 12 constitutes the exposure process.

The liquid development device 14 holds the liquid developer so that the liquid developer is located opposite to the electrostatic latent image formed on the surface of the photosensitive drum 10. The liquid developer includes a carrier liquid having electrical insulation property and colored particles dispersed in the carrier liquid. Thus, the electrostatic latent image formed on the surface of the photosensitive drum 10 is visualized with the charged colored particles, and developed as an image. The operation of this liquid development device 14 constitutes the development process.

As shown in FIG. 2, the liquid development device 14 includes a developer container 140, a development roller 141, a supply roller (an anilox roller) 142, a support roller 143, a supply roller blade 144, a development cleaning blade 145, a developer collection device 146, and a development roller charging device 147.

The developer container 140, which is supplied with the liquid developer therein, holds the liquid developer. After the adjustment of the concentration of the carrier liquid and the colored particles are performed in advance, the liquid developer is supplied to the inside of the developer container 140 from a supply nozzle 278. In this case, the liquid developer is supplied to a nip portion between the supply roller 142 and the support roller 143. A surplus amount of the liquid developer falls downward from the support roller 143, to be stored at the bottom of the developer container 140. The liquid developer thus stored, after being collected through a pipe 82, is recycled and reused.

The support roller 143 is disposed almost in the center of the developer container 140, and forms a nip portion by having contact with a lower portion of the supply roller 142. The supply roller 142 is disposed not immediately above the support roller 143 but displaced in a direction away from the supply nozzle 278. In the circumferential surface of the supply roller 142, grooves for holding the liquid developer is provided. As indicated by a dotted arrow in FIG. 2, the support roller 143 rotates in an anticlockwise direction, and the supply roller 142 rotates in a clockwise direction.

The liquid developer supplied from the supply nozzle 278 is temporarily stored upstream of the nip portion, between the supply roller 142 and the support roller 143, in the rotation direction of the support roller 143. The liquid developer thus stored is carried upward while being held in the grooves of the supply roller 142, along with the rotation of both the rollers 142 and 143. The supply roller blade 144 is pressed by the circumferential surface of the supply roller 142, and controls the amount of the liquid developer held in the grooves of the supply roller 142 by scraping off the liquid developer so as to control the amount of the liquid developer at a predetermined amount. The surplus liquid developer scrapped off by the supply roller blade 144 is stored at the bottom of the developer container 140.

The development roller 141 is disposed in an opening portion in an upper part of the developer container 140, so as to be in contact with the supply roller 142. The development roller 141 rotates in the same direction as the supply roller 142. As a result, in the nip portion where the development roller 141 and the supply roller 142 come into contact with each other, the surface of the development roller 141 moves in an opposite direction to the surface of the supply roller 142. Thus, the liquid developer held in the circumferential surface of the supply roller 142 is passed onto the circumferential surface of the development roller 141. Since the amount of the liquid developer (thickness of the thin layer of the liquid developer) held in the grooves of the supply roller 142 is controlled at a predetermined value, the amount of the liquid developer (thickness of the thin layer of the liquid developer) that is born by the surface of the development roller 141 is also maintained at a predetermined value.

A development roller charging device 147 applies to the development roller 141 a bias potential having the same polarity as the charge polarity of the colored particles from an outer surface side of the development roller 141 (development corona charge). With this, the development roller charging device 147 shifts the colored particles in the thin layer of the liquid developer that is born by the surface of the development roller 141, to the surface side of the development roller 141. As a result, the colored particles in the thin layer of the liquid developer are collected and compressed at the development roller side 141 by electric field effects (compaction processing), so that a layer of highly-concentrated colored particles is formed at the development roller 141 side. After this, the thin layer of the liquid developer is supplied to the photosensitive drum 10, and an electrostatic latent image on the photosensitive drum 10 is developed. Thus, a fine image with improved development efficiency is formed. The development roller charging device 147 is provided more downstream in the rotation direction of the development roller 141 than a contact portion between the development roller 141 and the supply roller 142, and more upstream in the rotation direction of the development roller 141 than a contact portion between the development roller 141 and the photosensitive drum 10, so as to be opposite to the circumferential surface of the development roller 141. In other words, the development roller charging device 147 generates an electric field due to development corona charge. Thus, the thin layer of the liquid developer on the development roller 141 is separated into two layers: a coloring particle layer on the surface of the development roller 141 and a carrier liquid layer on the coloring particle layer. In the development area (an area where the development roller 141 and the photosensitive drum 10 are facing each other and the peripheral area thereof), the thin layer of the liquid developer on the development roller 141, which is thus formed in two layers, come into contact with the surface of the photosensitive drum 10. At this time, the colored particles collected and compressed at the development roller 141 side shift from the surface of the development roller 141 to the surface of the photosensitive drum 10 according to the principle of the electrophoresis, thus visualizing the electrostatic latent image on the surface of the photosensitive drum 10 as an image. Caused by the development corona charge from the development roller charging device 147, before development, the colored particles in the thin layer of the liquid developer on the development roller 141 are compressed on the surface of the development roller 141 (compaction processing). Since the colored particles have no contact with a non-image area on the photosensitive drum 10, it is possible to suppress the occurrence of fogging in the formed image. In addition, due to the electric field formed by the development corona charge, charges are injected into the colored particles in the thin layer of the liquid developer on the development roller 141, so that the colored particles are responsively developed on the electrostatic latent image on the photosensitive drum 10 due to the development electric field and also the colored particles are electrostatically and firmly attached the surface of the photosensitive drum 10.

The development roller 141 comes into contact with the photosensitive drum 10. Due to a potential difference between the potential of the electrostatic latent image on the surface of the photosensitive drum 10 and the development electric field applied to the development roller 141, an image based on the image data is formed on the surface of the photosensitive drum 10.

A development cleaning blade 145 is disposed so as to come into contact with the development roller 141 at a position that is a downstream side of a portion where the development roller 141 and the photosensitive drum 10 have contact with each other in the rotation direction of the development roller 141. The development cleaning blade 145 removes the liquid developer finished the development operation performed on the photosensitive drum 10 and remaining on the surface of the development roller 141.

A developer collection device 146 collects the liquid developer removed by the development cleaning blade 145, and sends out the liquid developer to a pipe 81 of a liquid developer circulation device. The liquid developer flows down along the surface of the development cleaning blade 145. Due to the high viscosity of the liquid developer, the developer collection device 146 includes a sending roller for supporting the sending out of the liquid developer.

A primary transfer roller 20 is disposed on a rear surface of the intermediate transfer belt 21, so as to be opposite to the photosensitive drum 10. To the primary transfer roller 20, a voltage having a reverse polarity to the polarity of the colored particles in the image is applied from the power source (not shown). The primary transfer roller 20 applies, to the intermediate transfer belt 21, a voltage having a reverse polarity to the polarity of the colored particles at a position having contact with the intermediate transfer belt 21. Since the intermediate transfer belt 21 has electrical conductivity, this applied voltage attracts colored particles to the surface side of the intermediate transfer belt 21 and the periphery thereof. In other words, the image developed on the surface of the photosensitive drum 10 is primary transferred onto the intermediate transfer belt 21. The intermediate transfer belt 21 functions as an image bearing member that bears and conveys the image onto the recording medium.

The cleaning device 26 is a device for cleaning the liquid developer that is not transferred from the photosensitive drum 10 to the intermediate transfer belt 21 and remains on the photosensitive drum 10. The cleaning device 26 includes a residual developer conveyance screw 261 and a cleaning blade 262. A residual developer conveyance screw 261 disposed in the cleaning device 26 carries the residual developer scraped off by the cleaning blade 262 and stored in the cleaning device 26, to the outside of the cleaning device 26.

The cleaning blade 262 having a sheet-like shape is extended in the direction of the rotation axis of the photosensitive drum 10 so as to be able to scrape off the liquid developer remaining on the surface of the photosensitive drum 10. One end of the cleaning blade 262 slidingly contacts the surface of the photosensitive drum 10, and scrapes off the liquid developer remaining on the photosensitive drum 10 along with the rotation of the photosensitive drum 10.

The charge neutralizing device 13 has a light source for neutralizing charges. After the cleaning blade 262 removes the liquid developer, the charge neutralizing device 13, in preparation for image forming in the next circumferential movement, neutralizes charges on the surface of the photosensitive drum 10, using the light from the light source.

A recording medium storage section 3 shown in FIG. 1 stores the recording medium on the surface of which an image is to be fixed and formed. The recording medium storage section 3 is disposed at the bottom of the wet-type image forming apparatus 1A. In addition, the recording medium storage section 3 includes a paper feed cassette (not shown) formed to be able to store the recording medium.

The secondary transfer section 4 transfers the image formed on the intermediate transfer belt 21, onto the recording medium. The secondary transfer section 4 includes the support roller 41 supporting the intermediate transfer belt 21 and the secondary transfer roller 42 disposed opposite to the support roller 41. It should be noted that in the present embodiment, a transfer device is made up of this secondary transfer section 4, the primary transfer roller 20, and the intermediate transfer belt 21. Then, the operation of this secondary transfer section 4 and the operation of the primary transfer roller 20 constitute the transfer process.

In an upper side of the secondary transfer section 4, as described earlier, a pair of conveyance rollers 8 are provided in place of the fixing section 5.

Into the ejection section 6 provided in the top surface of the wet-type image forming apparatus 1A, the recording medium on which the image has been transferred and fixed is ejected. The recording medium conveyance section 7 includes a plurality of pairs of conveyance rollers. In addition, the recording medium conveyance section 7 feeds the recording medium from the recording medium storage section 3 to the ejection section 6 via the secondary transfer section 4. This operation of the recording medium conveyance section 7 for ejecting, into the ejection section 6, the recording medium on which the image has been transferred constitutes the ejection process.

With the image forming method according to the second embodiment as thus far described, in the image forming method using the liquid developer and including predetermined processes, the liquid developer according to the first embodiment is applied as the liquid developer. This allows sufficiently fixing the colored particles onto the recording medium while reducing the amount of consumption of the thermal energy or light energy for fixing the colored particles onto the recording medium. Accordingly, the image forming method according to the second embodiment is preferably performed in the image forming apparatuses that employ a various types of wet-type development methods.

EXAMPLES

The following describes the present disclosure further specifically with examples. It should be noted that the present disclosure is not limited in any case based on the examples.

Preparation Example 1

Preparing Elastomer a Solution (A-1) to (A-12)

The elastomer A solution was prepared using the elastomer A (n-1) to (n-4) that is a styrene-butadiene-based elastomer not having an acid group or a basic group and selected from those described below, and using, as the solvent, the carrier liquid S-1 and carrier liquid S-2 as described below.

(Elastomer A)

n-1: styrene-butadiene-based elastomer (SBS) (Tafplen (trademark) 315P (manufactured by Asahi Kasei Chemicals Corporation))

n-2: styrene-butadiene-based elastomer (SBS) (Asaplen (trademark) T412 (manufactured by Asahi Kasei Chemicals Corporation))

n-3: styrene-butadiene-based elastomer (SBS) (Asaplen (trademark) T413 (manufactured by Asahi Kasei Chemicals Corporation))

n-4: styrene-butadiene-based elastomer (SBS) (Asaplen (trademark) T438 (manufactured by Asahi Kasei Chemicals Corporation))

(Solvent)

Carrier liquid S-1: (liquid paraffin, MORESCO-WHITE (trademark) P55 (manufactured by MORESCO Corporation))

Carrier liquid S-2: (liquid paraffin, MORESCO-WHITE (trademark) P350 (manufactured by MORESCO Corporation))

Into a 1000-ml four-neck flask having a cooling pipe (Liebig condenser), a thermometer, a stirrer (AS ONE Tornado Standard SM 102 (manufactured by AS ONE Corporation)), and a nitrogen introduction pipe, the elastomer A of types and in amounts as described in Table 1 and the carrier liquid S-1 and the carrier liquid S-2 in the amounts described in Table 1 were placed. While stirring the obtained content in the flask at a stirring rate of 300 rpm, the temperature of the content in the flask was increased up to 170° C. After increasing the temperature, the content was stirred for 120 minutes while maintaining the temperature of the content in the flask at 170° C., so as to obtain the elastomer A solution.

TABLE 1

| | | Composition [% by mass] | | |
|---|---|---|---|---|
| Elastomer A solution | Elastomer A Type | Elastomer A | Carrier liquid S-1 | Carrier liquid S-2 |
| A-1 | n-1 | 8 | 46 | 46 |
| A-2 | n-2 | 8 | 46 | 46 |
| A-3 | n-3 | 8 | 46 | 46 |
| A-4 | n-3 | 12.5 | 43.75 | 43.75 |
| A-5 | n-4 | 12.5 | 43.75 | 43.75 |
| A-6 | n-1 | 12.5 | 43.75 | 43.75 |
| A-7 | n-2 | 10 | 45 | 45 |
| A-8 | n-3 | 12 | 44 | 44 |
| A-9 | n-3 | 10 | 45 | 45 |
| A-10 | n-4 | 10 | 45 | 45 |
| A-11 | n-1 | 12 | 44 | 44 |
| A-12 | n-1 | 10 | 45 | 45 |

[Preparing Elastomer B Solution (B−1) to (B-10)]

The elastomer B solution was prepared using elastomer B (p−1) or elastomer B (p-2) that is a styrene-based elastomer having an acid group or a basic group and selected from those described below, and using, as the solvent, the carrier liquid S-1 and the carrier liquid S-2 as described above.

(Elastomer B)

p-1: styrene-based elastomer (SBS) (TAFTEC (trademark) MP10 (manufactured by Asahi Kasei Chemicals Corporation))

p-2: styrene-based elastomer (SBS) (TAFTEC (trademark) M1943 (manufactured by Asahi Kasei Chemicals Corporation))

The elastomer B solution was prepared in the same manner as the elastomer A solution, except that the elastomer B of types and in amounts as described Table 2 and the carrier liquid S-1 and the carrier liquid S-2 in the amounts as described in Table 2 were used.

TABLE 2

| | | Composition [% by mass] | | |
|---|---|---|---|---|
| Elastomer B solution | Elastomer B Type | Elastomer B | Carrier liquid S-1 | Carrier liquid S-2 |
| B-1 | p-1 | 4 | 48 | 48 |
| B-2 | p-2 | 4 | 48 | 48 |
| B-3 | p-1 | 10 | 45 | 45 |
| B-4 | p-1 | 6 | 47 | 47 |
| B-5 | p-2 | 10 | 45 | 45 |
| B-6 | p-1 | 8 | 46 | 46 |
| B-7 | p-2 | 8 | 46 | 46 |
| B-8 | p-1 | 15 | 42.5 | 42.5 |
| B-9 | p-2 | 5 | 47.5 | 47.5 |
| B-10 | p-1 | 5 | 47.5 | 47.5 |

Examples 1 to 12 and Comparative Examples 1 to 21

Preparing a Mill Base

The mill base was prepared using aniline black (manufactured by TODA KOGYO CORP.) in the amount as described in each of Tables 3 to 7 and the elastomer A solution and the elastomer B solution in the amount as described in each of Tables 3 to 7 were mixed for 5 minutes at a stirring rotation rate of 8000 rpm, using a stirrer ("ROBOMIX" manufactured by PRIMIX Corporation).

(Preparing the Liquid Developer)

The mill base thus obtained was wet pulverized at a drive frequency of 50 Hz for 120 minutes, using a rocking mill ("RM-10" manufactured by SEIWA GIKEN Co., Ltd), so as to obtain a liquid developer. The mean volume particulate diameter ($D_{50}$) of the colored particles in the liquid developer thus obtained was approximately 5 μm. The mean volume particulate diameter ($D_{50}$) of the colored particles was measured according to the method below. Tables 3 to 7 show the results of the measurement.

<Method for Measuring the Mean Volume Particle Diameter (D50)>

Into a glass bottle, 0.5 g of a sample and 50 g of the carrier liquid A (fluid paraffin, MORESCO-WHITE (trademark) P-55 (manufactured by MORESCO Corporation) with an average carbon number of 22.0) were put and evenly mixed. A 1.0-g mixture thus obtained and 20 g of the carrier liquid A were put into another glass bottle, and was evenly mixed, so as to obtain a dilution (a dilution obtained by diluting the sample to 2000 times by mass, using fluid paraffin). Using the dilution thus obtained as the sample, the mean volume particle diameter ($D_{50}$) of the colored particles in the sample was measured at 25° C., using Zetasizer ZS (manufactured by Malvern Instruments Ltd.).

<<Evaluatiom>>

According to the method below, in the wet-type image forming apparatus that does not include a fixing section, the fixability of the liquid developer obtained in each of Examples 1 to 12 and Comparative Examples 1 to 21 was evaluated. Tables 3 to 7 each show, along with the result of the evaluation, the content of the elastomer A [% by mass] and the content of the elastomer B [% by mass] in the liquid developer.

<Image Forming Method>

Using a monochrome printer 1A that does not include a fixing section (an experimental machine manufactured by Kyocera Document Solutions Ltd., at a linear velocity of 116 mm/second), the image forming unit FB was filled with the liquid developer, and image was formed. Using fine quality plain paper ("C2" manufactured by Oji Paper Co., Ltd.) as the recording medium, a square solid image (5 cm×5 cm) evenly filled in was formed with a pigment equivalent to a pigment mount amount of 90 g/m$^2$. For forming the image, the thickness of the liquid developer layer on the circumferential surface of the development roller was set to 3 μm. In addition, when forming the image based on the image data on the surface of the photosensitive drum, the development electric field to be applied to the development roller was set to 400 V. The other conditions for image forming are described below.

The bias potential of the development corona charge of the development roller charging device 147: 4000 V Material for the intermediate transfer belt 21: polyimide Dark potential of the photosensitive drum 10: +550 V Bright potential of the photosensitive drum 10: +10 V Primary transfer voltage of the primary transfer roller 20: 300 V (constant voltage control)

Secondary transfer current of the secondary transfer roller 42: 40 μA (constant current control)

(Evaluation of Fixability)

The evaluation was performed on the fixability of a solid image portion when the solid image was transferred from the secondary transfer section onto the recording medium and the recording medium was ejected into the ejection section, using the image density measured before and after a rubbing test. The rubbing test was performed five minutes after the image was formed from the secondary transfer section, by moving a metal weight back and forth 10 times on a part of the formed solid image. It should be noted that the metal weight had a columnar shape, with a bottom covered with a cloth, and having a mass of 1 kg and a diameter of 50 mm After the rubbing test, the image density of the solid image on which the rubbing test was not performed (density before the rubbing test) and the image density of the solid image on which the rubbing test was performed (density after the rubbing test) were measured using a spectrodensitometer ("X-rite Spectro-Eye" manufactured by GretagMacbeth Limited). From the density before the rubbing test and the density after the rubbing test that have been measured, the fixing rate was calculated using the formula below. The fixability was evaluated based on the reference below.

Fixing rate [%]=(density after the rubbing test/density before the rubbing test)×100

Good: the fixing rate is 80% or more.

Poor: the fixing rate is 80% or less.

TABLE 3

| Example | | 1 | 2 | 3 | 4 | 5 | 6 |
|---|---|---|---|---|---|---|---|
| Composition of mill base [% by mass] | | | | | | | |
| Aniline black | | 10 | 10 | 10 | 10 | 13 | 13 |
| Elastomer | Type | A-1 | A-2 | A-1 | A-3 | A-4 | A-5 |
| A solution | Amount | 75 | 75 | 75 | 75 | 64 | 64 |
| Elastomer | Type | B-1 | B-1 | B-2 | B-2 | B-1 | B-1 |
| B solution | Amount | 15 | 10 | 15 | 10 | 10 | 20 |
| Carrier liquid S-1 | | — | 2.5 | — | 2.5 | 6.5 | 1.5 |
| Carrier liquid S-2 | | — | 2.5 | — | 2.5 | 6.5 | 1.5 |
| Content of elastomer A [% by mass] | | 6.00 | 6.00 | 6.00 | 6.00 | 8.00 | 8.00 |
| Content of elastomer B [% by mass] | | 0.60 | 0.40 | 0.60 | 0.40 | 0.40 | 0.80 |
| Evaluation of fixability | | | | | | | |
| Fixing rate [%] | | 82 | 85 | 84 | 86 | 83 | 82 |
| Determination | | Good | Good | Good | Good | Good | Good |

TABLE 4

| Example | | 7 | 8 | 9 | 10 | 11 | 12 |
|---|---|---|---|---|---|---|---|
| Composition of mill base [% by mass] | | | | | | | |
| Aniline black | | 13 | 13 | 15 | 13 | 13 | 15 |
| Elastomer | Type | A-4 | A-5 | A-6 | A-1 | A-7 | A-8 |
| A solution | Amount | 64 | 64 | 64 | 75 | 70 | 66 |
| Elastomer | Type | B-2 | B-2 | B-3 | B-4 | B-1 | B-5 |
| B solution | Amount | 10 | 20 | 8 | 12 | 15 | 8 |
| Carrier liquid S-1 | | 6.5 | 1.5 | 6.5 | — | 1.0 | 5.5 |
| Carrier liquid S-2 | | 6.5 | 1.5 | 6.5 | — | 1.0 | 5.5 |
| Content of elastomer A [% by mass] | | 8.00 | 8.00 | 8.00 | 6.00 | 7.00 | 7.92 |
| Content of elastomer B [% by mass] | | 0.40 | 0.80 | 0.80 | 0.72 | 0.60 | 0.80 |
| Evaluation of fixability | | | | | | | |
| Fixing rate [%] | | 85 | 83 | 83 | 87 | 86 | 88 |
| Determination | | Good | Good | Good | Good | Good | Good |

TABLE 5

| Comparative Example | | 1 | 2 | 3 | 4 | 5 | 6 | 7 |
|---|---|---|---|---|---|---|---|---|
| Composition of mill base [% by mass] | | | | | | | | |
| Aniline black | | 10 | 10 | 13 | 15 | 10 | 10 | 10 |
| Elastomer | Type | A-1 | A-2 | A-9 | A-10 | A-6 | A-6 | — |
| A solution | Amount | 75 | 75 | 75 | 80 | 47 | 66 | — |
| Elastomer | Type | — | — | — | — | — | — | B-6 |
| B solution | Amount | — | — | — | — | — | — | 5 |
| Carrier liquid S-1 | | 7.5 | 7.5 | 6.0 | 2.5 | 21.5 | 12.0 | 42.5 |
| Carrier liquid S-2 | | 7.5 | 7.5 | 6.0 | 2.5 | 21.5 | 12.0 | 42.5 |
| Content of elastomer A [% by mass] | | 6.00 | 6.00 | 7.50 | 8.00 | 5.88 | 8.25 | — |
| Content of elastomer B [% by mass] | | — | — | — | — | — | — | 0.40 |
| Evaluation of fixability | | | | | | | | |
| Fixing rate [%] | | 49 | 54 | 50 | 55 | 53 | 60 | 32 |
| Determination | | Poor | Poor | Poor | Poor | Poor | Poor | Poor |

TABLE 6

| Comparative Example | | 8 | 9 | 10 | 11 | 12 | 13 | 14 |
|---|---|---|---|---|---|---|---|---|
| Composition of mill base [% by mass] | | | | | | | | |
| Aniline black | | 10 | 10 | 10 | 15 | 15 | 15 | 15 |
| Elastomer | Type | — | — | — | — | A-11 | A-11 | A-12 |
| A solution | Amount | — | — | — | — | 50 | 50 | 80 |
| Elastomer | Type | B-6 | B-7 | B-8 | B-8 | B-3 | B-3 | B-3 |
| B solution | Amount | 75 | 85 | 60 | 60 | 3.8 | 8.2 | 3.8 |
| Carrier liquid S-1 | | 7.5 | 2.5 | 15.0 | 12.5 | 15.6 | 13.4 | 0.6 |
| Carrier liquid S-2 | | 7.5 | 2.5 | 15.0 | 12.5 | 15.6 | 13.4 | 0.6 |

TABLE 6-continued

| Comparative Example | 8 | 9 | 10 | 11 | 12 | 13 | 14 |
|---|---|---|---|---|---|---|---|
| Content of elastomer A [% by mass] | — | — | — | — | 6.00 | 6.00 | 8.00 |
| Content of elastomer B [% by mass] | 6.00 | 6.80 | 9.00 | 9.00 | 0.38 | 0.82 | 0.38 |
| Evaluation of fixability | | | | | | | |
| Fixing rate [%] | 68 | 68 | 67 | 59 | 61 | 63 | 66 |
| Determination | Poor | Poor | Poor | Poor | Poor | Poor | Poor |

TABLE 7

| Comparative Example | | 15 | 16 | 17 | 18 | 19 | 20 | 21 |
|---|---|---|---|---|---|---|---|---|
| Composition of mill base [% by mass] | | | | | | | | |
| Aniline black | | 15 | 14 | 10 | 10 | 10 | 10 | 10 |
| Elastomer A solution | Type | A-11 | A-12 | A-12 | A-12 | A-12 | A-11 | A-11 |
| | Amount | 64 | 59 | 59 | 59.7 | 59.7 | 67.1 | 67.1 |
| Elastomer B solution | Type | B-3 | B-3 | B-9 | B-9 | B-5 | B-3 | B-10 |
| | Amount | 8.2 | 4 | 8 | 7.7 | 8.1 | 8.1 | 7.7 |
| Carrier liquid S-1 | | 6.4 | 11.5 | 11.5 | 11.3 | 11.1 | 7.4 | 7.6 |
| Carrier liquid S-2 | | 6.4 | 11.5 | 11.5 | 11.3 | 11.1 | 7.4 | 7.6 |
| Content of elastomer A [% by mass] | | 7.68 | 5.90 | 5.90 | 5.97 | 5.97 | 8.05 | 8.05 |
| Content of elastomer B [% by mass] | | 0.82 | 0.40 | 0.40 | 0.39 | 0.81 | 0.81 | 0.39 |
| Evaluation of fixability | | | | | | | | |
| Fixing rate [%] | | 54 | 63 | 69 | 69 | 73 | 75 | 67 |
| Determination | | Poor | Poor | Poor | Poor | Poor | Poor | Poor |

The liquid developers obtained in Examples 1 to 12 each include a predetermined amount of: colored particles including aniline black, elastomer A that is a styrene-butadiene-based elastomer not having an acid group or a basic group, and elastomer B that is a styrene-based elastomer having an acid group or a basic group. The liquid developer allows sufficiently fixing the colored particles onto the recording medium even when applied to an image forming apparatus that does not include the fixing section and therefore does not consume heat energy or light energy for fixing the colored particles onto the recording medium.

What is claimed is:

1. A liquid developer comprising:

a carrier liquid having electrical insulation property;

colored particles; and an organic elastomer, wherein the organic elastomer is dissolved in the carrier liquid, the organic elastomer includes:

elastomer A having a repeating unit derived from styrene or a styrene derivative and a repeating unit derived from butadiene, and not having an acid group or a basic group; and elastomer B having a repeating unit derived from styrene or a styrene derivative, and having an acid group or a basic group, a content of the elastomer A in the liquid developer is 6% by mass or more and 8% by mass or less, a content of the elastomer B in the liquid developer is 0.4% by mass or more and 0.8% by mass or less, and the colored particles include aniline black.

2. A liquid developer according to claim 1, wherein a mass average molecular weight of the organic elastomer is 40,000 or more and 150,000 or less.

3. A liquid developer according to claim 1, wherein a content of the aniline black in the liquid developer is 10% by mass or more and 15% by mass or less.

4. An image forming method according to a wet-type development method, comprising:

charging a surface of a photosensitive drum;

forming an electrostatic latent image on the charged surface of the photosensitive drum;

developing the electrostatic latent image on the surface of the photosensitive drum, using the liquid developer according to claim 1;

transferring the developed image onto a recording medium; and ejecting the recording medium onto which the image has been transferred, to an ejection section.

* * * * *